United States Patent [19]

Brammer et al.

[11] Patent Number: 4,462,347

[45] Date of Patent: Jul. 31, 1984

[54] IGNITION DISTRIBUTOR FOR INTERNAL COMBUSTION ENGINE

[75] Inventors: Hartmut Brammer, Vaihingen; Harry Kaiser, Markgröningen, both of Fed. Rep. of Germany

[73] Assignee: Robert Bosch GmbH, Stuttgart, Fed. Rep. of Germany

[21] Appl. No.: 405,743

[22] Filed: Aug. 4, 1982

[30] Foreign Application Priority Data

Sep. 26, 1981 [DE] Fed. Rep. of Germany ..... 3138390

[51] Int. Cl.[3] ..... F02P 7/02

[52] U.S. Cl. ..... 123/146.5 A; 123/617; 123/647

[58] Field of Search ..... 123/146.5 A, 617, 647, 123/612, 613; 200/19 R, 19 DR, 31 CA, 31 DP, 31 V; 310/70 R, 70 A

[56] References Cited

U.S. PATENT DOCUMENTS

| | | | |
|---|---|---|---|
| 2,016,669 | 10/1935 | Davis, Jr. | 200/19 R |
| 3,783,314 | 1/1974 | Kostan | 123/617 |
| 3,855,983 | 12/1974 | Valek | 123/146.5 A |
| 4,165,726 | 8/1979 | Helmer, Jr. | 123/146.5 A |
| 4,359,978 | 11/1982 | Brammer et al. | 123/146.5 A |

*Primary Examiner*—Andrew M. Dolinar

*Attorney, Agent, or Firm*—Frishauf, Holtz, Goodman & Woodward

[57] ABSTRACT

The casing (10) of the distributor has integral internal ribs (14) and a bearing body (12) into which at least one of the bushings (16,17) of the bearing is pressed. The shoulders (15) provided on the ribs support an annular sheet steel plate (23) that carries the stationary portion (21) of a Hall transducer. The plate is centered on the sleeve-like end (13) of the bearing body and supported on the shoulders of the ribs, being secured in this position by screws to each of the three ribs. The integral construction of the casing, ribs and bearing body and the screwing down of the plate simplify manufacture and assembly of the distributor.

9 Claims, 2 Drawing Figures

IGNITION DISTRIBUTOR FOR INTERNAL COMBUSTION ENGINE

This invention concerns an ignition distributor having a cup-shaped casing enclosing a two-bushing bearing in which a shaft is rotatably set that carries a rotor, with a plate provided within the casing to carry the stationary components and circuit forming a pulse generator with the rotor.

In a known ignition distributor the bearing is a metal sleeve which is fastened to the casing by means of a bushing and the plate is crimped onto the sleeve for its support and holds a mechanical interrupter which is actuated by a rotary cam affixed to the distributor shaft.

The separate manufacturing of the sleeve and the crimp-rolling on of the plate make the manufacture of the distributor expensive to an extent that is disadvantageous for mass production.

THE INVENTION

It is an object of the present invention to reduce the number of parts that need to be made for a distributor, to eliminate the separate manufacture of the bearing sleeve and to provide a sturdy as well as an economical device having a long service life.

Briefly, the principal portion of the bearing is formed integrally with the casing in its manufacture, thus eliminating the crimping operation. Ribs of the casing are provided on its interior each having a shoulder to which the plate is simply screwed down, making possible extensive automating of the assembly of the distributor. In one embodiment the free end of the bearing is formed as a sleeve with an external taper, on which the plate can be quickly and firmly centered in manufacture. In another embodiment the plate is provided with an internal collar inside of which a bushing of the bearing is fixed which is also fitted into the portion of the bearing structure which is integral with the casing. This embodiment makes it possible to hold the bushing securely even under extreme operation conditions involving vibration or the like.

When the distributor is of the Hall generator type producing pulses for ignition distribution control it is of advantage to have one half of a plug connector set in the part of the casing below the plate so that the leads can be brought to the stationary portion of the Hall generator in a configuration in which much of their length is shielded against the Hall generator.

The invention is further described by way of illustrative example with reference to the annexed drawing, in which:

FIG. 1 is a cross-sectional view of one embodiment of the distributor according to the invention, and FIG. 2 is a cross-sectional of a second embodiment of the invention.

DESCRIPTION OF THE ILLUSTRATED EMBODIMENT

Figure 1:
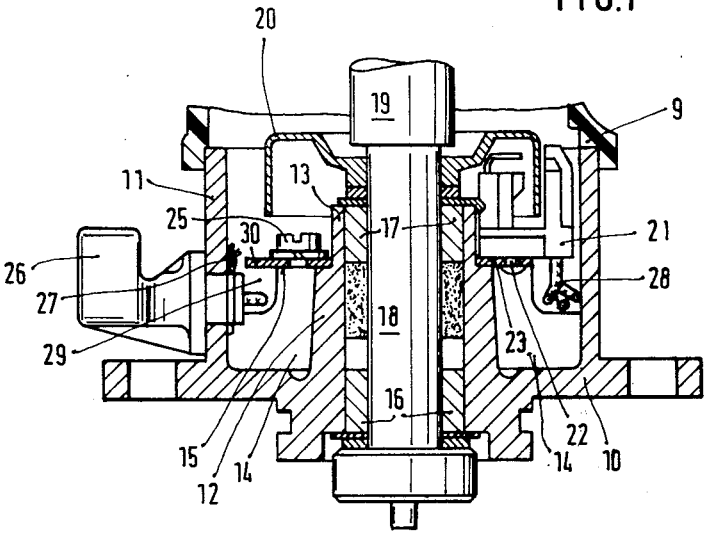

The engine ignition distributor shown in FIG. 1 has a casing 10 made of pressure cast light metal and having a cylindrical wall 11 and an internal sleeve-shaped bearing 12, of which the end portion is formed as a sleeve 13 with a tapered external diameter. On the interior of the casing 10 are three evenly distributed ribs 14 each having a shoulder 15. In the lower end section of the bearing 12 a first bushing 16 is pressed in and in the sleeve 13 a second bushing 17 is likewise pressed in, the shaft 18 being rotatably set in the two bushings. A removable cap 9 of insulating material covers the casing 10.

A spark gap rotor 19, only partly shown, which cooperates with electrodes set in the distributor cap in the usual way, is affixed to the end of the shaft 18 and the rotor 20 of a Hall-effect pulse generator is also affixed to the shaft 18 for rotation therewith. The stator 21 (stationary portion) of the Hall transducer is permanently fastened to the plate 23 by a number of rivets 22, of which only one is visible. The plate 23 has a central hole 24 and centers itself in assembly by the hole 24 on the tapered sleeve 13 while it is supported on the shoulder 15 of each of the three ribs 14. This centered and supported position of the plate 23 is then secured by three screws 25 respectively screwed into the ribs 14.

One half of an electrical plug connector is firmly mounted in the wall 11 of the casing 10 by means of a spring 27. Three leads 28 lead from the connector 26 to the stator 21 of the Hall transducer. These are cabled together and passed in a cut out niche 29 provided on the outer portion of the ribs 14, a corresponding cut-out of the plate 23 allowing passage of the cabled leads to Hall generator.

Figure 2:
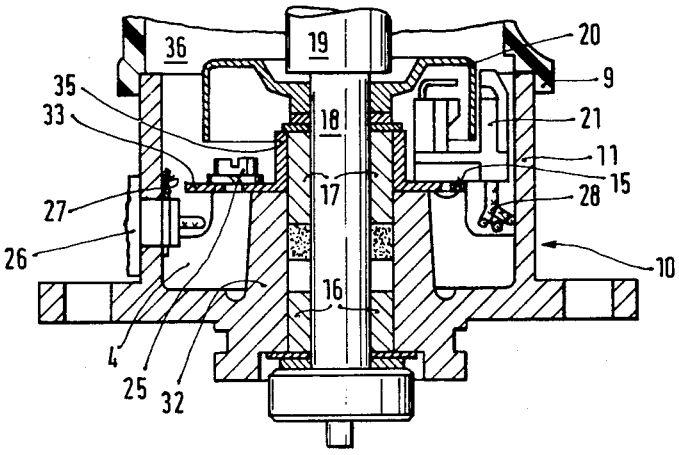

In the second embodiment shown in FIG. 2 parts that are the same or similar as or to those already described have the same reference numerals. In contrast to the embodiment of FIG. 1 the plate 33 of FIG. 2 is a drawn stamping of sheet steel and has a cylindrical collar 35 formed integral therewith, which extends into the interior chamber 36 of the casing 10. The bushing 17 is in this case pressed into the collar 35 and its projecting extends below into the bearing body 32, where it snugly fits.

Although the invention has been described with respect to two illustrative embodiments, it will be recognized that other variations are possible within the inventive concept.

We claim:

1. Ignition distributor for an internal combustion engine, having a casing providing a two-bushing bearing, a shaft rotatably set in said bearing, an annular plate in said casing perpendicular to the axis of said shaft and abutting said bearing, a pulse generator of which the stationary portion is affixed to said plate, and comprising the improvement which consists in that:

said casing (10) includes a centrally upstanding shell (12) of said bearing and has at least three internal ribs (14) upstanding from the bottom of the casing and each having a radial extremity and a shoulder (15), rising higher than the radial extremity of the rib and abutting said bearing shell (12), for supporting said plate, and said plate (23,33) is fastened to said ribs (14) by screws (25).

2. Distributor as defined in claim 1 in which said casing (10), except for a removable cap (9) therefor, said ribs (14) and said bearing shell (12,32) are made in one piece.

3. Distributor as defined in claim 2 in which said bearing shell (12) has a free end portion in the shape of a sleeve tapered in external diameter (13), on the outer surface of which said plate (23) is centered.

4. Distributor as defined in claim 1, in which said plate (23) is a stamping of sheet metal.

5. Ignition distributor for an internal combustion engine, having a casing providing a two-bushing bearing, a shaft rotatably set in said bearing, an annular plate in said casing perpendicular to the axis of said shaft and abutting said bearing, a pulse generator of which the stationary portion is affixed to said plate, and comprising the improvement which consists in that:

said casing (10) has at least three internal ribs (14), each having a shoulder (15) for supporting said plate, and said plate (33) is fastened to said ribs (14) by screws (25) and has a guiding cylindrical collar (35) in which a bushing (17) of said bearing is fixed.

6. Distributor as defined in claim 5 in which said pulse generator is a Hall transducer having a rotor (20) fixed for rotation on said shaft (18) and having its stationary portion affixed to said plate (23,33) nonremovably by rivets (22).

7. Distributor as defined in claim 6 having one-half of a plug connection set in the wall of said casing (10) and also connection leads from said connector half to said Hall transducer, the contour of said plate (23,33) providing in cooperation with each of said ribs (14) a niche for a cable composed of said connection leads (28), said half of said plug connector (26) being located in the region of said casing (10) which is beneath said plate (23,33).

8. Distributor as defined in claim 7 in which said plate (33) in a stamping of sheet steel.

9. Distributor as defined in claim 5, in which said casing (10), except for a removable cap (9) therefor, is made in one piece with said ribs (14) and with a shell (32) of said bearing for holding at least one (16) of said bushings therein.

* * * * *